US008478149B2

(12) United States Patent
Takazawa

(10) Patent No.: US 8,478,149 B2
(45) Date of Patent: Jul. 2, 2013

(54) BELT DEVICE, TRANSFERRING UNIT AND IMAGE FORMING DEVICE

(75) Inventor: Takayuki Takazawa, Tokyo (JP)

(73) Assignee: Oki Data Corporation, Tokyo (JP)

( * ) Notice: Subject to any disclaimer, the term of this patent is extended or adjusted under 35 U.S.C. 154(b) by 323 days.

(21) Appl. No.: 12/957,812

(22) Filed: Dec. 1, 2010

(65) Prior Publication Data

US 2011/0142463 A1 Jun. 16, 2011

(30) Foreign Application Priority Data

Dec. 11, 2009 (JP) ..... 2009-282230

(51) Int. Cl.
*G03G 15/00* (2006.01)

(52) U.S. Cl.
USPC ..... 399/49; 399/101; 399/123; 399/308

(58) Field of Classification Search
USPC ..... 399/101, 123, 162, 302, 303, 308, 399/313, 314, 343, 350
See application file for complete search history.

(56) References Cited

U.S. PATENT DOCUMENTS

| | | | | |
|---|---|---|---|---|
| 2003/0202819 | A1* | 10/2003 | Matsuda et al. | 399/121 |
| 2005/0100806 | A1* | 5/2005 | Hongo et al. | 430/78 |
| 2007/0003302 | A1* | 1/2007 | Mizes | 399/49 |
| 2007/0201911 | A1* | 8/2007 | Ito | 399/299 |

FOREIGN PATENT DOCUMENTS

| | | |
|---|---|---|
| JP | A-2007-078517 | 3/2007 |
| JP | A-2007-225969 | 9/2007 |

* cited by examiner

*Primary Examiner* — Walter L Lindsay, Jr.
*Assistant Examiner* — Roy Y Yi
(74) *Attorney, Agent, or Firm* — Posz Law Group, PLC

(57) ABSTRACT

A belt device includes an endless belt including at least a base layer and a coat layer, the coat layer formed on the base layer and configuring an upper most surface of the belt; a driving member that rotates the belt and that is provided at one end of the belt to bias an inner circumferential surface of the belt; and a driven member that rotates the belt and that is provided at other end of the belt to bias the inner circumferential surface of the belt. Wherein the base layer has a mirror specularity of 20-60.

16 Claims, 5 Drawing Sheets

BELT DEVICE, TRANSFERRING UNIT AND IMAGE FORMING DEVICE

CROSS REFERENCE

The present application is related to, claims priority from and incorporates by reference Japanese patent application number 2009-282230, filed on Dec. 11, 2009.

TECHNICAL FIELD

The present invention relates to a belt device that includes a belt for transferring a toner image on a recording medium, a transferring unit that includes the belt device and an image forming device that includes the transferring unit.

BACKGROUND

As a conventional image forming device that uses an electrographic process, such as a printer, a photocopy machine, a facsimile machine and an electrographic color recording device, a device that is, for example, disclosed in Japanese laid-open patent application publication number 2007-225969 is known. In the device, there is a belt in which a light reflection ratio of an entire belt is kept within a certain range by defining characteristics relating to surface roughness and a mirror specularity (MS), which is an indicator of condition or degree of a mirror surface, and so on of an entire belt surface that transfers a toner image on a recording medium or the like.

However, because light quantity of specular reflection light at a belt surface is largely different among several portions of the entire belt surface when interference fringes are generated on the belt surface in the device with the structures discussed above, there was a problem that toner image density that was transferred on the belt cannot accurately be detected.

The present invention is made in view of the problem mentioned above. An object of the present invention is to provide a belt device that includes a belt that is explained below, a transferring unit that includes the belt device and an image forming device that includes the transferring unit. The belt has the following characteristics. Toner image density that was transferred on the belt can be detected with a high degree of accuracy by preventing an occurrence of interference fringes on the belt and by keeping a light reflection ratio of the entire belt surface within a certain range.

SUMMARY

In order to resolve the problem mentioned above, a belt device disclosed in the present application includes an endless belt including at least a base layer and a coat layer, the coat layer formed on the base layer and configuring an upper most surface of the belt; a driving member that rotates the belt and that is provided at one end of the belt to bias an inner circumferential surface of the belt; and a driven member that rotates the belt and that is provided at other end of the belt to bias the inner circumferential surface of the belt. Wherein the base layer has a mirror specularity of 20-60.

The belt device according to the disclosure can prevent interference fringes on the belt from generating and can keep a light reflection ratio of the entire belt surface within a certain range. Therefore, toner image density that was transferred on the belt can be detected with a high degree of accuracy.

BRIEF DESCRIPTION OF THE DRAWINGS

FIG. 7A shows linear interference fringes. FIG. 7B shows circular interference fringes.

DETAILED DESCRIPTION

Figure 1:
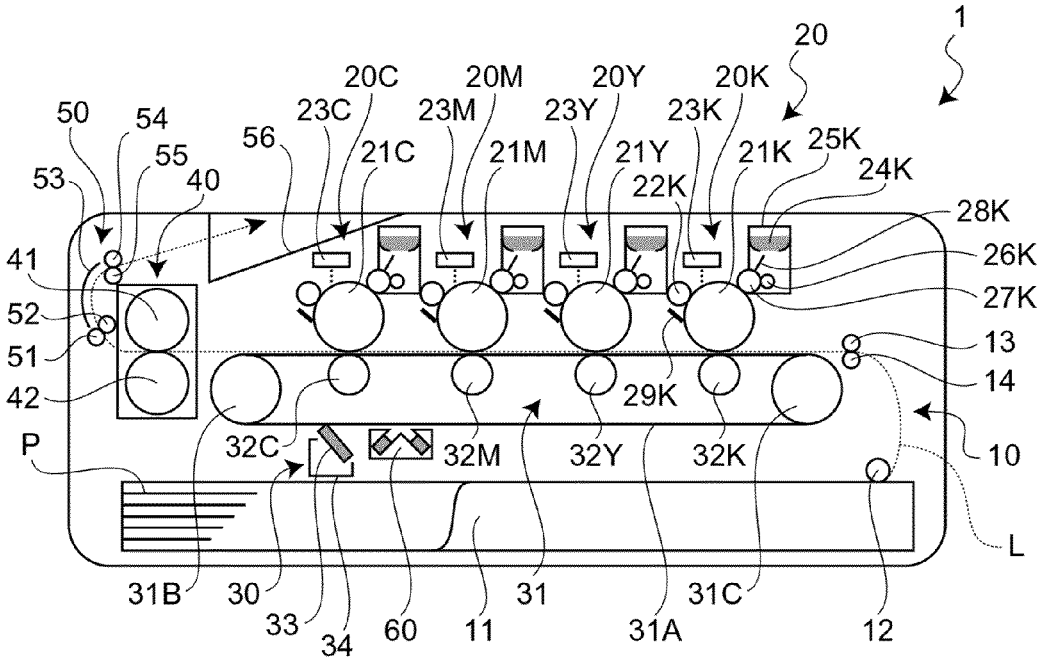
FIG. 1 is a schematic view of an image forming device that is common in first and second embodiments according to the present invention.

A belt device, a transferring unit and an image forming device according to a preferred embodiment of the present invention is explained below with reference to drawings. The belt device, the transferring unit and the image forming device according to the present invention are not limited to the following description. It will be apparent the same may be varied in many ways. Such variations are not to be regarded as a departure from spirit and scope of the invention, and all such modifications as would be apparent to one of ordinary skill in the art are intended to be included within the scope of the following claims.

An explanation will be done in the following order. First of all, configuration and operation of a belt device 31, a transferring unit 30 that includes the belt device 31, and an image forming device 1 that includes the transferring unit 30 that are common in first and second embodiments according to the present invention are explained with reference to FIGS. 1 and 2. Next, configuration and measurement principle of a mirror specularity measurement device 100 that measures the mirror specularity of a belt 31A of the belt device 31 that is common in the first and second embodiments according to the present invention are explained with reference to FIGS. 3 through 5. Furthermore, configuration and evaluation of a belt 35A that is provided at the belt device 31 of the first embodiment according to the present invention are explained with reference to FIGS. 6, 7A and 7B, and Table 1. Lastly, configuration and evaluation of a belt that is provided at the belt device 31 of the second embodiment according to the present invention are explained with reference to FIGS. 8 and 9, and Table 2.

Figure 2:
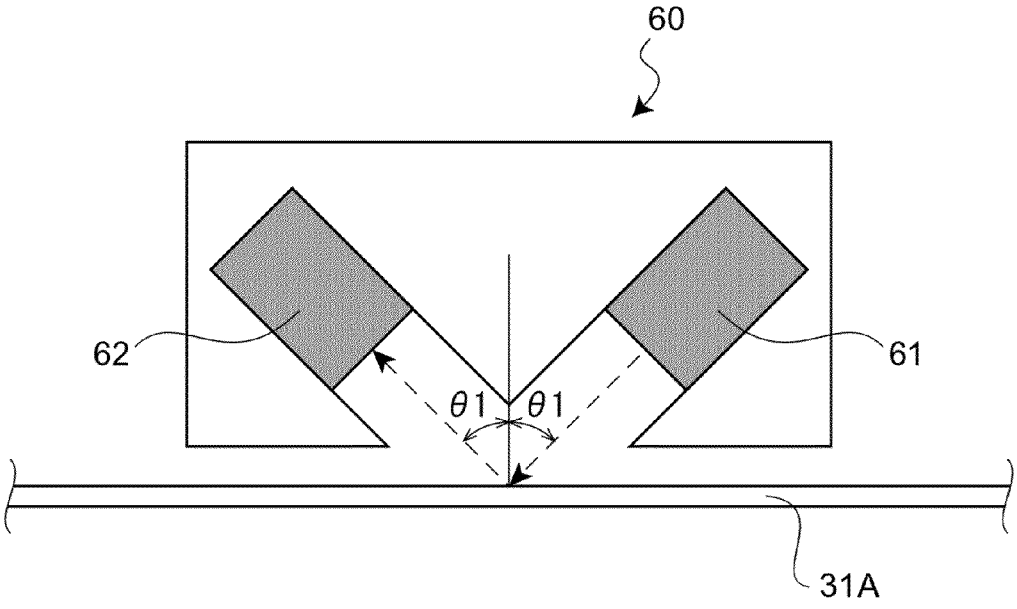
FIG. 2 is a schematic view of an image density detection unit that is provided inside of an image forming device that is common in first and second embodiments according to the present invention.

First, configuration and operation of the belt device 31, the transferring unit 30 that includes the belt device 31, and the image forming device 1 that includes the transferring unit 30 that are common in the first and second embodiments according to the present invention are explained with reference to FIGS. 1 and 2. FIG. 1 is a schematic view of the image forming device 1. FIG. 2 is a schematic view of an image density detection unit 60.

The image forming device 1 prints an image on a recording medium P based on image information that corresponds to each color of black, yellow, magenta and cyan. The image forming device 1 is configured with a sheet feeding unit 10 in which the recording medium P is fed from a sheet feeding cassette 11 and is put on the belt 31A that is provided inside the transferring unit 30 by static electricity, a developing unit 20 in which a toner image is formed based on image information from a host device (not shown), the transferring unit 30 in which the toner image that is formed by the developing unit 20 is transferred on the recording medium P or the belt 31A, a fusion unit 40 in which the toner image that is transferred on the recording medium P by the transferring unit 30 is fused by melting and pressing the toner image, an ejecting unit 50 in which the recording medium P that is ejected by the fusion unit 40 is ejected to a catch tray 56 in the manner in which a print side of the recording medium P is a back side, and the image density detection unit 60 in which density of the tone image that is transferred on the belt 31A of the belt device 31 is detected. A sheet carrying path L is a nearly S-shaped path in which the recording medium P is carried inside the sheet feeding unit 10, the developing unit 20, the transferring unit 30, the fusion unit 40, and the ejecting unit 50.

The sheet feeding unit 10, the developing unit 20, the transferring unit 30, the fusion unit 40, the ejecting unit 50, and the image density detection unit 60 that configure the image forming device 1 is explained in detail.

The sheet feeding unit 10 feeds the recording medium P from the sheet feeding cassette 11 and put it on the belt 31A that is provided inside the transferring unit 30 by static electricity. The sheet feeding unit 10 is configured with the sheet feeding cassette 11, a hopping roller 12, a pressure roller 13, and a registration roller 14. Each of structural members that configure the sheet feeding unit 10 is explained in detail below. The sheet cassette 11 stacks a plurality of the recording mediums P and feeds the recording medium P to inside the image forming device when a print operation is started. The sheet feeding cassette 11 is detachable to the image forming device 1. The recording medium P is a recording sheet with a certain size on which black and white, or color image information is printed and is generally configured with plain paper, recycled paper, glossy paper, high-quality paper, a plastic sheet, an OHP film and so on. The hopping roller 12 separate the recording medium P from the sheet feeding cassette 11 one by one by rotating and pressing the recording medium P stacked in the sheet feeding cassette 11 so that the recording medium P is carried to the pressure roller 13 and the registration roller 14. The pressure roller 13 and the registration roller 14 are provided to face each other by sandwiching the recording medium carried from the hopping roller 12. The recording medium P is carried to the belt 31A that is provided inside the transferring unit 30 and is put on the belt 31A by static electricity while waved and inclined recording mediums P are corrected through rotating the pressure roller 13 that is pressed by the registration roller 14.

The developing unit 20 forms a toner image based on image information that corresponds to each color from the host device (not shown). Specifically, developing units 20K, 20Y, 20M, and 20C that correspond to black, yellow, magenta, and cyan colors, respectively, are provided inside the image forming device 1 in the order of and along with a carrying direction of the recording medium P. Because each of the developing units 20K, 20Y, 20M, and 20C has the same configuration, it is referred to as the developing unit 20. The developing unit 20 is explained by using the developing unit 20K that corresponds to black color.

The developing unit 20K is configured with a photosensitive drum 21K on which an electrostatic latent image based on the image information is carried, a charge roller 22K that makes electrical charge on a surface of the photo receptor drum 21K, an LED head 23K in which light that corresponds to the image information is irradiated to the surface of the photosensitive drum 21K and that is provided at a body of the image forming device 1, a toner cartridge 25K that stores toner 24K as developer, a toner supplying roller 26K that supplies the toner 24K to a developing roller 27K, the developing roller 27K that develops electrostatic latent image that is formed on the surface of the photosensitive drum 21K by the toner 24K, a developing blade 28K that regulate an uniform thickness of the toner 24K carried on the developing roller 27K, and a cleaning blade 29K that scrapes the toner 24 remaining on the photosensitive drum 21K. The developing unit 20K is detachable to the image forming device 1. Each of structural members that configure the developing unit 20K is explained in detail below.

With respect to the developing unit 20K, the photosensitive drum 21K that is provided inside the developing unit 20K is an image carrier on which a developer image is formed. The photosensitive drum 21K is also configured to be able to have electrical charge on the surface for carrying an electrostatic latent image based on image information. The photosensitive drum 21K is configured with a cylindrical-shaped part and is rotatable. The photosensitive drum 21K is formed by forming a photosensitive layer made of a photo-conductive layer and a charge transporting layer on a conductive base layer made of aluminum or the like. The charge roller 22K makes uniform electrical charge on the surface of the photosensitive drum 21K through applying a positive voltage or a negative voltage to the surface of the photosensitive drum 21K by using an electrical power supply (not shown). The charge roller 22K is rotatable while contacting the surface of the photosensitive drum 21K with a certain amount of pressure. The charge roller 22K is formed by coating semi-conductive rubber that is made of silicone on a conductive metal shaft.

Similarly, with respect to the developing unit 20K, the LED head 23K irradiates light that corresponds to the image information to the surface of the photosensitive drum 21K and is provided at a body of the image forming device 1 above the photosensitive drum 21K. The LED head 23 K is configured with a combination of a plurality of LED elements, lens arrays, and LED driving elements. Specification of the toner 24 is as follows: main structural composition is styrene-acrylic copolymer by an emulsion polymerization method; 9% by weight of paraffin wax is included; average grain diameter is 7 μm; and sphericity is 0.95. By using the toner 24 with the above specification, the following benefits can be obtained. Transferring efficiency is increased. A release agent is omitted at the time of fusing. Developing with excellent dot repeatability and resolution of an image is performed. As a result, sharpness of an image and high image quality are obtained. The toner cartridge 25K is a container for storing the toner 24K and is assembled above the toner supplying roller 26K. A side part of the toner cartridge 25K is a nearly circular shape. The toner cartridge 25*k* has a long rectangular part in a perpendicular direction with respect to a carrying direction of the recording medium P. The toner cartridge 25K is detachable to change the cartridge in the case in which the toner 24K is consumed by a print operation.

Similarly, with respect to the developing unit 20K, the toner supplying roller 26K that is provided inside the developing unit 20K supplies the toner 24K to the developing roller 27K by pressing the developing roller 27K while rotating itself. The toner supplying roller 26K is formed by, for example, coating rubber containing a blowing agent on a conductive metal shaft. The developing roller 27K is rotatable while contacting the surface of the photosensitive drum 21K with a certain amount of pressure. The developing roller 27K carries the toner 24K toward the photosensitive drum 21K while rotating and develops an electrostatic latent image that is formed on the surface of the photosensitive drum 21K by using the toner 24K. The developing roller 27K is configured with a cylindrical-shaped part that is formed by coating a semi-conductive urethane rubber or the like on a conductive metal shaft.

Similarly, with respect to the developing unit 20K, a tip part of the developing blade 28K presses the surface of the developing roller 27K. The developing blade 28K regulates an uniform thickness of the toner 24K formed on the developing roller 27K by scraping the toner 24K that exceeds a certain amount of toner that is supplied on the surface of the developing roller 27K from the toner supplying roller 26K. The developing blade 28K is configured with a plate-like elastic member that is made of stainless. The cleaning blade 29K is configured with a plate-like member that is made of rubber or the like. A tip part of the cleaning blade 29K presses the surface of the photosensitive drum 21K to scrape the remaining toner 24K on the photosensitive drum 21K after the toner image formed on the photosensitive drum 21K is transferred to the recording medium P.

The transferring unit 30 transfers the toner image formed by the developing unit to the recording medium P or the belt 31A. The transferring unit 30 is configured with the belt device 31 and a transferring roller 32. The belt device 31 is configured with the belt 31A, a driving roller 31B as a driving member, and a driven roller 31C as a driven member. The transferring unit 30 may include a cleaning blade 33 and a waste toner box 34 in addition to the belt device 31 and the transferring roller 32. Each of structural members that configure the transferring unit 30 is explained in detail below. The driving roller 31B and the driven roller 31C are located at both ends of the endless belt 31A and at an inner circumferential surface of the belt, respectively, and apply a certain amount of tension. The driving roller 31B and the driven roller 31C are made of a member with high frictional resistance. When the driving roller 31B is rotatably driven by a drive system (not shown), the belt 31A is driven so that the driven roller 31C is driven by driving of the belt 31A. The belt 31A functions to carry the recording medium P to the developing unit 20 for transferring image information and to put the recording medium P on the circumference surface of the endless belt 31A by static electricity. Detailed configuration of the belt according to the first and second embodiments is discussed later.

With respect to the transferring unit 30, the transferring roller 32K is located below the photosensitive drum 21K and is rotatable while pressing the photosensitive drum 21K so as to sandwich the recording medium P with the photosensitive drum 21K. A bias voltage that is opposite polarity from charge of the toner 24K is applied to the transferring roller 32K so that the toner image that is formed on the surface of the photosensitive drum 21K is transferred on the recording medium P or the belt 31A. The cleaning blade 33 is configured with a plate-like elastic member. A tip part of the cleaning blade 33 presses the surface of the belt 31A with a certain amount of pressure to scrape a patch pattern transferred on the belt 31A, and the toner 24K and adherent materials, such as paper dust and so on, that are adhered on the surface of the belt 31A. The waste toner box 34 is a container to collect the toner 24 and the adherent materials, such as paper dust and so on, that are scraped by the cleaning blade 33 so that the waste toner box 34 is located close to the cleaning blade 33 and below the belt 31A.

The fusion unit 40 fuses the toner image that is transferred on the recording medium P by the transferring unit 30 through melting and pressing the toner image. The fusion unit 40 is configured with a fusion roller 41 and pressure application roller 42. Each of structural members that configure the fusion unit 40 is explained in detail below. The fusion roller 41 and the pressure application roller 42 are provided opposite to each other so as to sandwich the recording medium P that is carried by the belt 31A and fuses the toner image that is transferred on the recording medium P. Specifically, the fusion roller 41 and the pressure application roller 42 are configured with a cylindrical-shaped part in which the surface is made with an elastic member. A heater, such as a halogen lamp, is located inside the cylindrical-shaped parts of both the fusion roller 41 and the pressure application roller 42. The fusion roller 41 and the pressure application roller 42 fuse the toner image to the recording medium P by melting the toner image that is adhered to the recording medium P with weak electrostatic force and then by using pressure from the pressure application roller 42. The pressure application roller 42 is driven by biasing from the rotation of the fusion roller 41.

The ejecting unit 50 ejects the recording medium P that is ejected by the fusion unit 40 to the catch tray 56 in the manner in which a print side of the recording medium P is a back side. The ejecting unit 50 is configured with carrying rollers 51 and 52, a sheet guide 53, ejecting rollers 54 and 55, and the catch tray 56. Each of structural members that configure the ejecting unit 50 is explained in detail below. The carrying rollers 51 and 52 are provided opposite to each other so as to sandwich the recording medium P that is carried from the fusion unit 40. The carrying roller 52 is driven by biasing from the rotation of the carrying roller 51 so that the recording medium P is carried to the ejecting rollers 54 and 55. The ejecting rollers 54 and 55 are provided opposite to each other so as to sandwich the recording medium P that is carried from the carrying rollers 51 and 52 through the sheet guide 53. The ejecting roller 55 is driven by biasing from the rotation of the ejecting roller 54 so that the recording medium P is ejected to the catch tray 56. The sheet guide 53 is a guide plate to introduce the recording medium P from the carrying rollers 51 and 52 toward the ejecting rollers 54 and 55, and is made with an arcuate curved aluminum plate. The catch tray 56 is storage space in which the recording medium P that is ejected after printing image information is stacked in the manner in which a print side of the recording medium P is a back side.

The image density detection unit 60 detects density of the tone image that is transferred on the belt 31A of the belt device 31. The image density detection unit 60 is configured with a light emitting element 61 and a light receiving element 62 that are provided as a reflection type sensor. The image density detection unit 60 is located below the belt 31A that is provided at the transferring unit 30. Each of structural members that configure the image density detection unit 60 is explained in detail below. The light emitting element 61 is, for example, an infrared ray LED as a light emitting diode and irradiates infrared rays as measurement light toward the belt 31A. The light emitting element 61 is inclined by an angle of θ1° in a clockwise direction with respect to a perpendicular direction from the surface of the belt 31A as shown in FIG. 2. The light receiving element 62 is, for example, a phototransistor and receives reflection light. The reflection light is generated at the toner 24 on the belt 31A by irradiating infrared rays from the light emitting element 61 toward the belt 31A in which the toner 24 is transferred. The light receiving element 62 is inclined by an angle of θ1° in a counterclockwise direction with respect to a normal direction (perpendicular direction) of the belt 31A as shown in FIG. 2. Specifically, the light receiving element 62 receives specular reflection light from the black color toner 24K that is transferred on the belt 31A and receives diffuse reflection light from the yellow, magenta, or cyan color toner 24 that is transferred on the belt 31A.

With respect to the image density detection unit 60, after the light receiving element 62 receives reflection light generated at the toner 24, the light receiving element 62 sends its information of the reflection light as an analog signal to a control unit (not shown). The analog signal that is received at the control unit is converted into a digital signal so that density of the toner 24 is calculated based on the digital signal. Toner density is corrected by calculating differences between the calculated density of the toner 24 discussed above and toner density of a property table that is predeterminly stored in a memory of the control unit. Specifically, after the toner 24 of black color is transferred on the belt 31A with, for example, the toner density of 30%, infrared rays are irradiated to the transferred toner 24 from the light emitting element 61. Then, specular reflection light that is generated at the toner 24 is received by the light receiving element 62 so that density of the toner 24 is calculated by the control unit. When the calculated density of the toner 24 corresponds to the toner density of 25% of the property table that is predeterminly stored in the memory of the control unit, 5% as differences between 30% and 25% is determined as an error so that the toner density is corrected. The property table for toner densities that are predeterminly stored has segmentalized toner densities in order to perform detection and correction for toner density of a toner image with a high degree of accuracy.

Figure 3:
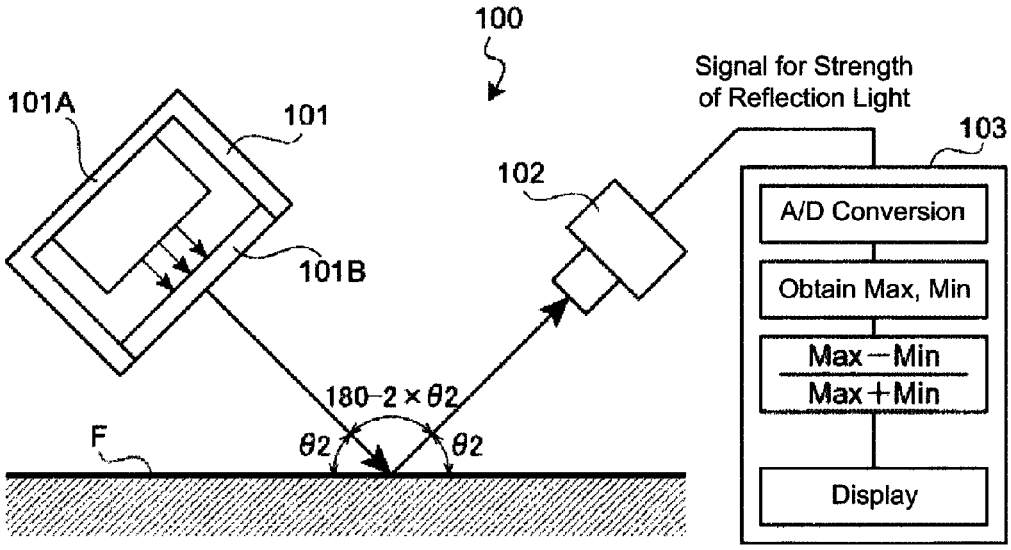
FIG. 3 is a schematic view of a mirror specularity measurement device.
Figure 4:
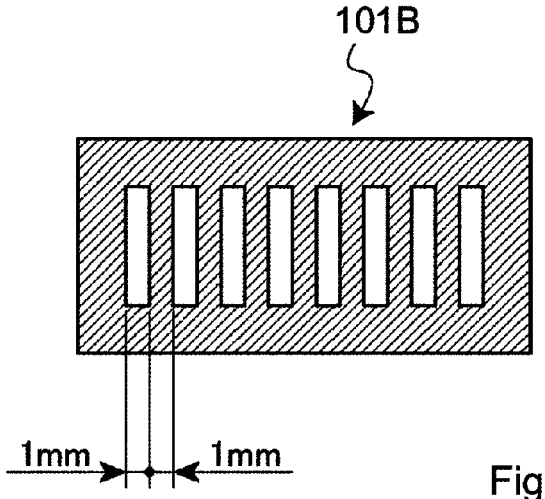
FIG. 4 is a schematic view of a pattern projection board that is provided at a pattern projection device of a mirror specularity measurement device.
Figure 5:
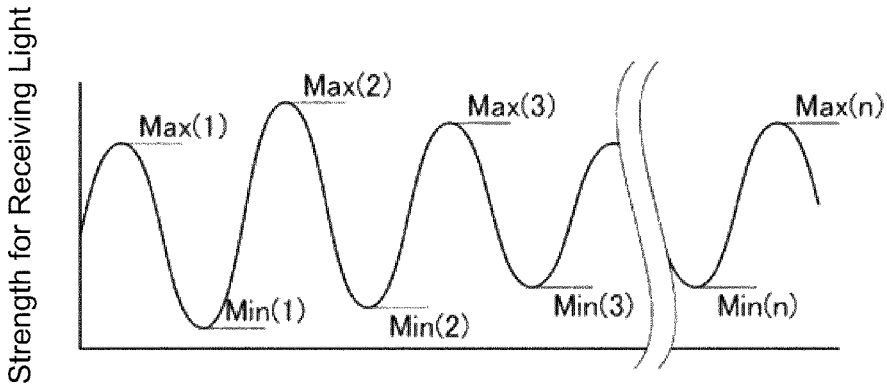
FIG. 5 is a pattern diagram showing waveforms that relate to a mirror specularity of an object surface to be measured (object surface) by a mirror specularity measurement device.

Configuration and measurement principle of a mirror specularity measurement device 100 are explained with reference to FIGS. 3 through 5. The mirror specularity measurement device 100 measure a mirror specularity for the belt 31A of the belt device 31 that is common in first and second embodiments according to the present invention. FIG. 3 is a schematic view of the mirror specularity measurement device 100. FIG. 4 is a schematic view of a pattern projection board 101B that is provided at a pattern projection device 101 of the mirror specularity measurement device 100. Similarly, FIG. 5 is a pattern diagram showing waveforms that relate to the mirror specularity of an object surface F to be measured (object surface F) by the mirror specularity measurement device 100.

As the mirror specularity measurement device 100, SPOT AHS-100S, a product name, which is manufactured by ARCHARIMA Co., Ltd. (Japanese Company), is used. A mirror specularity is defined as quantifying light reflection ratio, surface roughness, and image clarity with respect to the object surface F. Configurations of the mirror specularity measurement device 100 are as follows. As shown in FIG. 3, the mirror specularity measurement device 100 is configured with the pattern projection device 101, a photoelectric conversion element 102, and a signal processing device 103. A light source 101A and the pattern projection board 101B are provided at the pattern projection device 101. As shown in FIG. 4, the pattern projection board 101B is made of a plate-like stainless member with a thickness of 0.5 mm and has eight openings with a width of 1 mm and an interval of 1 mm. In FIG. 4, the openings are in a slit-like shape so that the projected pattern on the object surface also has the slit-like shape. Matte coating is applied on the surface of the pattern projection board 101B as an antireflection film. The pattern projection device 101 is held at an angle of θ2° with respect to the object surface F to irradiate light. An optical axis of the photoelectric conversion element 102 is on the same plane of an optical axis of the pattern projection device 101 and is held at an angle of (180°−2×θ2°). A CCD array that is formed by arranging a plurality of CCDs in one or two dimension is, for example, used for the photoelectric conversion element 102. The signal processing device 103 calculates the mirror specularity for the object surface F based on input information from the photoelectric conversion element 102.

Measurement principle of the mirror specularity measurement device 100 is explained. When parallel light is irradiated to the pattern projection board 101B from the light source 101A of the pattern projection device 101, a light-dark pattern as a test pattern is projected on the object surface F. The light-dark pattern, specifically, a strength of reflection light for the light-dark pattern, is converted into an electrical signal through imaging by the photoelectric conversion element 102. The electrical signal from the photoelectric conversion element 102 is input to the signal processing device 103 so that an A/D conversion is performed for the electrical signal. Data in which the A/D conversion is performed (A/D converted data) is in waveforms shown in FIG. 5. Note that the data in FIG. 5 corresponds to the strength of the reflection light for the light and dark parts from the object surface. An average value of maximal values (Max (Ave)) for each waveform and an average value of minimal values (Min (Ave)) for each waveform are calculated based on A/D converted data. As a result, the mirror specularity shown by expression 1 is obtained. Note that when the object surface F shown in FIG. 3 has a complete ideal surface, the mirror specularity of the object surface F is 1000. The mirror specularity is rounded off to the closest whole number and is shown as integer numbers. The mirror specularity according to the present application shows sharpness of a reference pattern with respect to a reflection image on the object surface F as a relative value between a reference plate and an object based on variation of brightness value distribution for brightness. Specifically, the mirror specularity of an ideal surface as a benchmark is 1000. When the mirror specularity of an object surface F is closer to 1000, the surface condition of the object surface F is better.

As shown in expression below, the mirror specularity is calculated based on light and dark parts in an object surface. When the mirror specularity is measured for a surface of a belt, a degree of smoothness of the belt is determined. As discussed above, when light is irradiated toward an ideal surface, reflection light without diffused reflection can be obtained. In this case, the mirror specularity is defined 1000.

$$\text{Mirror Specularity} = \frac{\text{Max}(Ave) - \text{Min}(Ave)}{\text{Max}(Ave) + \text{Min}(Ave)} \times 1000 \qquad \text{Expression 1}$$

$$\text{Here: Max}(Ave) = \frac{\sum \text{Max}(n)}{n}$$

$$\text{Min}(Ave) = \frac{\sum \text{Min}(n)}{n}$$

(First Embodiment)

Configuration and evaluation of a belt 35A that is provided at the belt device 31 of the first embodiment according to the present invention are explained with reference to FIGS. 6, 7A and 7B, and Table 1.

First, configuration of the belt 35A is explained with reference to FIG. 6. FIG. 6 is a schematic view of a side surface of the belt 35A that is provided at the belt device 31 of the transferring unit 30.

Figure 6:
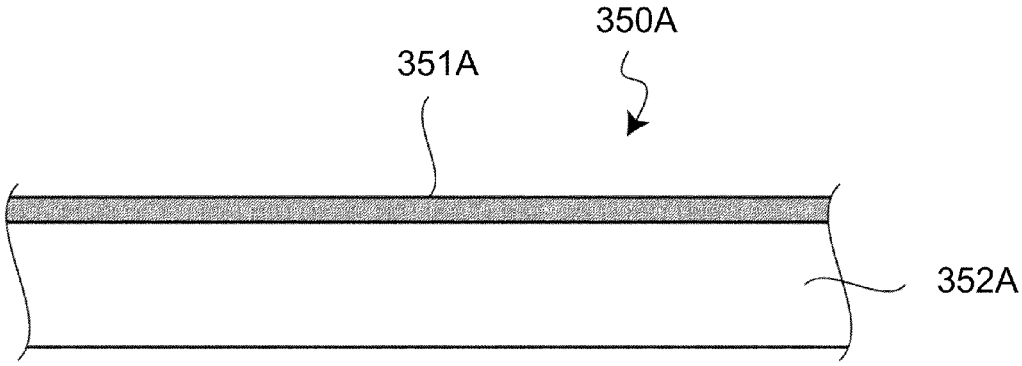
FIG. 6 is a schematic view of a side surface of a belt that is provided at a belt device of a transferring unit of an image forming device according to a first embodiment of the present invention.
Figure 7A:
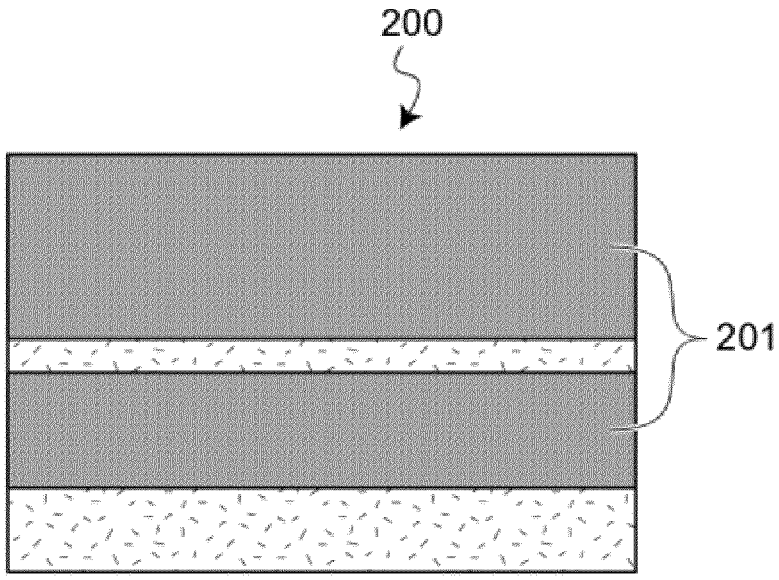
FIGS. 7A and 7B are pattern diagrams showing interference fringes that are repeatedly appeared on a conventional belt surface. Specifically.
Figure 7B:
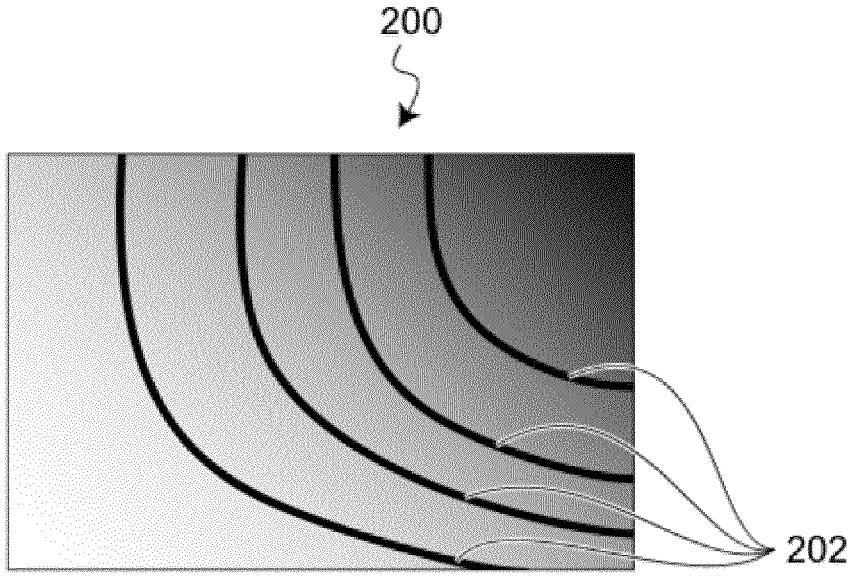

As shown in FIG. 6, the belt 35A is configured with at least a two-layer structure, a base layer 352A as a base member for a coat layer 351A, and the coar layer 351A as a carrier surface for a toner image. In the belt 35A, at the beginning, the base layer 352A is formed, then the coat layer 35A' is formed. The base layer 352A is made of a polyamide-imide (PAI) material and includes a certain amount of carbon black to have conductivity. Those materials are agitated and mixed in N-methylpyrrolidone (NMP) solution. Then, they are processed by rotational molding so as to have a layer thickness of 100 μm and an internal diameter of ϕ198 mm. After that, the base layer 352A is formed in an endless form with a width of 228 mm by cutting. A surface condition of the base layer 352A depends on surface accuracy of a mold that is used for rotational molding. Therefore, a surface condition of the belt 35A can be adjusted by polishing the surface of the mold accordingly. In this embodiment, a plurality of the base layers 352A of which the mirror specularity is in a range of 20-100 are formed. However, a method for making the base layer 352A is not limited to the rotational molding. The following molding methods can be used in accordance with a material of the base layer 352A: extrusion molding, inflation molding, centrifugal molding, dip molding and so on.

With respect to configuration of the belt 35A, the base layer 352A that is formed by the above method is attached to a peripheral surface of a mold with a certain dimension. Then, after the coat layer 351A is formed on the base layer 352A through dip coating by using a coating agent with a different dilution ratio, the coat layer 351A is hardened by UV irradiation. As a result, the coat layer 351A is formed with a layer thickness of 100-1500 nm. However, a method for making the coat layer 351A is not limited to the dip coating. The following coating methods can be used: roller coating and spray coating. A thermal hardening can be used as a hardening method for the coat layer 351A in accordance with material property. A layer thickness of the coat layer 351A is adjusted by density or amount of coating materials. It is preferred as materials for the coat layer 351A that poly-acrylic urethane, poly-acrylic, polyester-urethane, polyether-urethane, polycarbonate (PC), polybutylene terephthalate (PBT), polyethylene terephthalate (PET), styrene compound, naphthalene compound and so on can be used. In this embodiment, poly-acrylic urethane is used. A material for the base layer 352A is not limited to a specific one. However, it is preferred to use a material in which a tension deformation while driving the belt 35A is in a certain range in terms of durability and mechanical property.

Similarly, with respect to configuration of the belt 35A, it is preferred that a material for the base layer 352A prevents sides of the base layer 352A from wearing, abrading, cracking, breaking and so on that are caused by a meandering prevention member that is located at sides of the belt 35A. It is preferred as materials for the base layer 352A that polyamide-imide, polyimide, polyvinylidene fluoride (PvDF), polyamide (PA), polybutylene terephthalate, polycarbonate (PC) and so on can be used. In this embodiment, polyamide-imide is used. A certain amount of carbon black is blended in the base layer 352A to have conductivity. Furnace black, channel black, ketjen black, acethylene black and so on can be used for carbon black that is blended in the base layer 352A. These blacks can be used as a single or a combination of them. A type of carbon black that is blended in the base layer 352A can be selected in accordance with target conductivity. In this embodiment, especially, channel black or furnace black is used.

Similarly, with respect to configuration of the belt 35A, it is preferred to use the base layer 352A in which oxidation treatment and graft treatment that avoids oxidation degradation are performed, and in which dispersibility into solution is improved depending on use of the base layer 352A. A contained amount of carbon black that is blended in the base layer 352A can be decided in accordance with a type of carbon black. In consideration of required mechanical strength and so on for the belt 35A according to the present application, the contained amount of carbon black is in a range of 3-40% by weight with respect to resin composition of the belt 35A. However, it is not limited to carbon assisted conductivity for a method to apply conductivity to the base layer 352A. A method in which conductivity is obtained by adding an ion conductive agent to the base layer 352A may be used. The following materials can be used for the ion conductive agent that gives the base layer 352A conductivity: alkali metal salt, alkaline-earth metal salt, quaternary ammonium salt, and so on, such as lithium perchlorate, sodium perchlorate, lithium trifluoromethanesulfonate, lithium tetrafluoroboranic acid, potassium thiocyanate, and lithium thiocyanate.

Next, evaluation of the belt 35A that is provided at the belt device 31 of the first embodiment according to the present invention is explained with reference to FIG. 7, and Table 1. FIGS. 7A and 7B are pattern diagrams showing interference fringes 201 and 202 that are repeatedly appeared on a surface of a conventional belt 200. Table 1 shows evaluation results of several kinds of the belts 35A.

Evaluation criteria were as follows: (1) whether interference fringes are existed on the belts 35A, (2) whether there is unevenness of light reflection ratios over an entire belt of the belts 35A, and (3) whether there is a volume resistivity increase of the belts 35A. These three evaluation methods are explained below. Existence or nonexistence of the interference fringes on the belts 35A was determined by visual observation. With respect to determination criteria for existence or nonexistence of the interference fringes in Table 1, determinations "○" represents that there was no problem because interference fringes were not observed; determinations "Δ" represents that interference fringes were partially observed; and determinations "x" represents that there was a problem because interference fringes were observed at an entire area. FIGS. 7A and 7B shows pattern diagrams of interference fringes that were periodically appeared on the surface of the conventional belt 200. Specifically, FIG. 7A shows linear interference fringes 201 that were appeared on the surface of the belt 200. FIG. 7B shows circular interference fringes 202 that were appeared on the surface of the belt 200. When such interference fringes 201 and 202 are generated on the surface of the belt 200, the amount of light of specular reflection light especially from the surface of the belt 200 is largely different in each location over an entire belt of the belt 200. Therefore, toner density for the black color toner 24K cannot be accurately detected.

With respect to the evaluation criteria for the belt 35A, unevenness of light reflection ratios at each portion over an entire belt of the belts 35A was determined based on the large or small of the variation of mirror specularities through measuring the mirror specularity for the total number of thirty areas (three areas in the width direction×ten areas in the circumferential direction of the belt 35A), by using the mirror specularity measurement device 100. With respect to determination criteria for unevenness of light reflection ratios in Table 1, determinations "○" represents that there was no problem because the variation of mirror specularities was equal to or less than 5; determinations "Δ" represents that the variation of mirror specularities was 6-10; and determinations "x" represents that there was a problem because the variation of mirror specularities was equal to or more than 11. Furthermore, a volume resistivity increase of the belts 35A was determined by using a high resistivity instrument, Hiresta-UP, that was manufactured by Mitsubishi Chemical Corporation. Specifically, after the belt 35A was stationary placed in an environment with a temperature of 25° C. and a humidity of 50% for twenty hour hours, a voltage of 250V was applied to the belt 35A for ten seconds. Then, it was determined based on differences of volume resistivity before and after coating. With respect to determination criteria for change of 1 volume resistivity in Table 1, determinations "○" represents that there was no problem because the volume resistivity increase was equal to or less than 3 times; determinations "Δ" represents that the volume resistivity increase was more than 3 times and was equal to or less than 5 times; and determinations "x" represents that there was a problem because the volume resistivity increase was more than 5 times.

TABLE 1

| | | Mirror Specularity after Coating | | | Determination | | |
|---|---|---|---|---|---|---|---|
| Experiments | Mirror Specularity of Base Layer Surface | Variation of Mirror Specularity over Entire Belt | Mirror Specularity | Thickness of Coat Layer (nm) | Interference Fringes | Unevenness of Light Reflection Ratios | Volume Resistivity Increase |
| 1 | 114 | 21 | 85 | 300 | x | x | ○ |
| 2 | 100 | 20 | 86 | | x | x | ○ |
| 3 | 82 | 16 | 82 | | x | x | ○ |
| 4 | 72 | 10 | 76 | 100 | Δ | Δ | ○ |
| 5 | 71 | 9 | 80 | 300 | Δ | Δ | ○ |
| 6 | 70 | 10 | 78 | 500 | Δ | Δ | ○ |
| 7 | 72 | 5 | 86 | 1000 | ○ | ○ | Δ |
| 8 | 70 | 3 | 81 | 1500 | ○ | ○ | Δ |
| 9 | 72 | 4 | 84 | 3000 | ○ | ○ | x |
| 10 | 60 | 4 | 75 | 100 | ○ | ○ | ○ |
| 11 | 60 | 4 | 76 | 300 | ○ | ○ | ○ |
| 12 | 58 | 3 | 80 | 500 | ○ | ○ | ○ |
| 13 | 62 | 3 | 76 | 1000 | ○ | ○ | Δ |
| 14 | 51 | 4 | 79 | 300 | ○ | ○ | ○ |
| 15 | 40 | 3 | 76 | | ○ | ○ | ○ |
| 16 | 32 | 3 | 60 | | ○ | ○ | ○ |
| 17 | 20 | 3 | 57 | | ○ | ○ | ○ |

According to evaluation results of the belts 35A, as shown in experiments 1 through 17 in Table 1, it is preferred that the mirror specularity of the base layer 352A is 20-60 in order to keep constant light reflection ratios over an entire belt of the belt 35A. In order to have the same occurrence of crack and the volume resistivity increase between the coat layer 351A and the base layer 352A, it is preferred that a layer thickness of the coat layer 351A is equal to or less than 1000 nm, and more preferably is equal to or less than 500 nm.

With respect to the evaluation results of the mirror specularity for the surface of the base layer 352A of the belt 35A, when the mirror specularity for the surface of the base layer 352A is 20-60, reflection light that is detected by the image density detection unit 60 is mainly specular reflection light from the surface of the belt 35A because light transmitted through the coat layer 351A is diffusely-reflected at the surface of the base layer 352A. Therefore, condition of the upper most surface of the belt 35A can be known. Specular reflection light from the upper most surface of the belt 35A can be relatively detected. As a result, the variation of mirror specularities in each portion over an entire belt can be decreased because the unevenness of light reflection ratios over the entire belt of the belts 35A becomes smaller. When density of the lack color toner 24K is detected by the image density detection unit 60, the surface of the belt 35A is a reference value. Therefore, since the unevenness of light reflection ratios in each portion over an entire belt is decreased, toner image density can be detected with a high degree of accuracy. In the case for detecting, especially, density of the black color toner 24K, when the unevenness of light reflection ratios for the surface of the belt 35A, light quantity of the reflection light that is detected by the image density detection unit 60 largely varies depending on each portion of the belt 35A even if differences of density of the toner image that is transferred to the belt 35A. If the coat layer 351A as a thin layer is provided on the base layer 352A of which the mirror specularity is less than 20, roughness for the upper most surface of the belt 35A is large by transferring irregularity of the base layer 352A to the coat layer 351A. As a result, it is difficult to completely perform cleaning for residues, such as the toner 24, that remain on the belt 35A.

With respect to the evaluation results of a layer thickness of the coat layer 351A of the belt 35A, the interference fringes generated at the belt 35A is attributed to unevenness in the order of several tens nm of a layer thickness of the coat layer 351A. However, it is difficult to control the layer thickness in the order of several tens nm by a simple method. When a layer thickness of the coat layer 351A is formed with high accuracy control, it is necessary to have a layer thickness of 100 nm or more. When the interference fringes occur on the surface of the belt 35A, toner density for the black color toner 24K cannot be accurately detected because light quantity of the specular reflection light from the surface of the belt 35A is largely different at each portion of an entire belt of the belt 35A. On the other hand, when a layer thickness of the coat layer 351A is thicker, the interference fringes lesser occur. However, when a layer thickness of the coat layer 351A is thicker, it is difficult that a resistance value of the belt 35A is controlled as designed because the volume resistivity of the belt 35A is increased. This is because the coat layer 351A is a high resistance body. When a layer thickness of the coat layer 351A is equal to or less than 500 nm, differences of the volume resistivity between the base layer 352A itself and a whole structure of the belt 35A can be equal to or less than three times.

Similarly, with respect to the evaluation results of a layer thickness of the coat layer 351A of the belt 35A, when a layer thickness of the coat layer 351A is thick, its following capability for the base layer 352A is impaired so that fatal problems, such as cracking and breaking, occur When the coat layer 351A have conductivity by adding a conductivity agent, there are problems of decreasing mechanical strength of the coat layer 351A and losing a balance between volume resistivity and surface resistivity. Therefore, it is necessary that the coat layer 351A as a thin layer is provided with respect to the base layer 352A that has a certain degree of the mirror specularity in order to prevent the interference fringes from occurring that is attributed to forming the coat layer 351A and to restrict the volume resistivity ratio.

As discussed above, the belt 35A that is provided at the belt device 31 of the first embodiment according to the present invention is formed in the following manner. Since the coat layer 351A with a layer thickness of 100 nm-500 nm is formed on the base layer 352A of which the mirror specularity is 20-60, an occurrence of the interference fringes on the belt 35A is prevented, and light reflection ratio at each portion of an entire belt of the belt 35A can be held in a certain range. Therefore, detection accuracy of toner density of a toner image at the image density detection unit 60, and correction accuracy of the toner density based on detection results can be improved. The belt 35A that is provided at the belt device 31 of the first embodiment according to the present invention is formed in the following manner. Since the coat layer 351A with a layer thickness of 100 nm-500 nm is formed on the base layer 352A of which the mirror specularity is 20-60, differences of the volume resistivity between the base layer 352A itself and a whole structure of the belt 35A can be equal to or less than three times.

(Second Embodiment)

Figure 8:
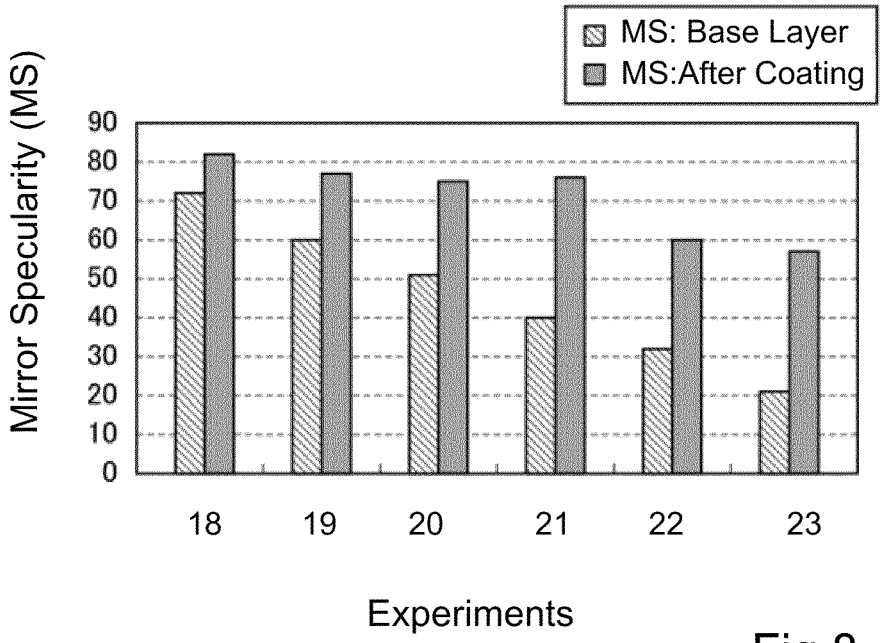
FIG. 8 is a bar chart showing mirror specularities of a base layer surface and a belt surface after coating on the base layer of a plurality of belts according to a second embodiment of the present invention.
Figure 9:
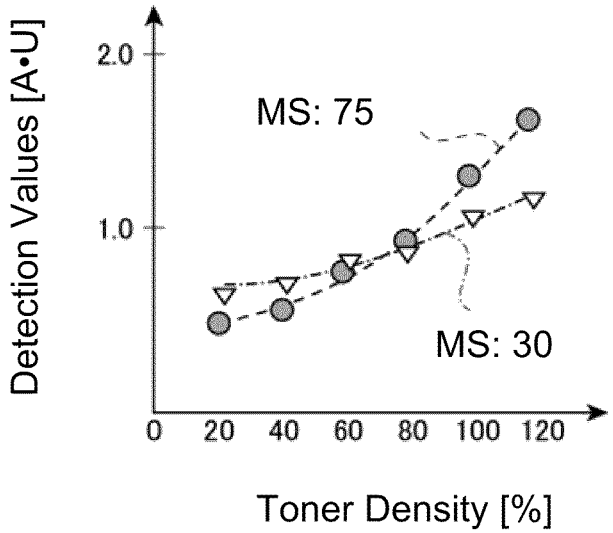
FIG. 9 is a graph showing toner density of a toner image that is transferred on belts that have a different mirror specularity and its detection value according to a second embodiment of the present invention.

Configuration and evaluation of a belt that is provided at the belt device 31 of a second embodiment according to the present invention are explained with reference to FIGS. 8 and 9, and Table 2. FIG. 8 and Table 2 are a bar chart and a table showing evaluation results for mirror specularities of a base layer surface and a belt surface after coating on the base layer of a plurality of belts, respectively. FIG. 9 is a graph showing toner density of a toner image that is transferred on belts that have a different mirror specularity and its detection value according to a second embodiment of the present invention.

A belt that is provided at the belt device 31 according to the second embodiment is formed in the following manner. A coat layer with a layer thickness of 100 nm-500 nm was formed on a base layer of which the mirror specularity is 20-72. For the reasons discussed later, it was preferred for the base layer to have the mirror specularity with 40-60 so that the mirror specularity of the upper most surface of the belt was equal to or more than 75 as a feature of the second embodiment. When the belt was formed by the method discussed above, i.e. the belt that has the coat layer formed on the base layer, light quantity of specular reflection light was increased without an occurrence of interference fringes on the belt. Other structures of the second embodiment were the same as the first embodiment. Therefore, structures of the second embodiment that are different from the first embodiment are mainly explained in detail.

With respect to detailed evaluation results for the mirror specularity of the base layer of the belt, FIG. 8 and Table 2 show evaluation results for the mirror specularities of a base layer surface and a belt surface after coating on the base layer of a plurality of belts. Specifically, belts for experiments 18 through 23 were manufactured by forming a coat layer that had the same property of a layer thickness of 300 nm and a material of acrylic urethane on a plurality of base layers in which the mirror specularities were in a range of 20-72. As shown in Table 2 below, when the mirror specularity of the base layer surface was 72, interference fringes emerged on a belt surface. When the mirror specularity of the base layer surface was 60 or less, interference fringes did not emerge, and a value of the variation of mirror specularity over an entire belt was small (actually 3 or 4). It is assumed that the light amount of specular reflection light is even. When the mirror specularity of the base layer surface was 40 or more, the mirror specularity of the upper most surface of the belt did not greatly depend on the mirror specularity of the base layer, and all of the mirror specularities of the upper most surface of the belt were 75 or more, being saturated around at 80. See Table 2, Experiments 18-21 and FIG. 8. However, when the mirror specularity of the base layer surface was less than 40, the mirror specularities of the upper most surface of the belt decreased according to the mirror specularities of the base layer. See Table 2, Experiments 22-23 and FIG. 8. It is assumed that the amounts of specular reflection light with respect to the upper most surface of the belt is small. According to these results, when the mirror specularity of the base layer surface is in a range of 40 through 60, even if a coat layer is formed on its surface, interference fringes do not emerge, and the amounts of specular reflection light can be even regardless of their locations of the belt. Further, when the mirror specularity of the upper most surface of the belt is equal to or more than 75, light quantity of specular reflection light is increased. As a result, detection accuracy for toner density of a toner image at the image density detection unit 60 is improved.

TABLE 2

| | | | Mirror Specularity after Coating | | Determination | |
|---|---|---|---|---|---|---|
| Experiments | | Mirror Specularity of Base Layer Surface | Variation of Mirror Specularity over Entire Belt | Mirror Specularity | Interference Fringes | Unevenness of Light Reflection Rations |
| Belt | 18 | 72 | 10 | 82 | Δ | Δ |
| | 19 | 60 | 3 | 77 | ○ | ○ |
| | 20 | 51 | 4 | 75 | ○ | ○ |
| | 21 | 40 | 3 | 76 | ○ | ○ |
| | 22 | 32 | 3 | 60 | ○ | ○ |
| | 23 | 20 | 3 | 57 | ○ | ○ |

With respect to detection accuracy of the image density detection unit 60 for mirror specularities of the base layer of the belt, FIG. 9 shows detection results of toner density through the image density detection unit 60. In FIG. 9, the detection results represent cases where toner images that had toner densities with a range of 20-120% were transferred on two belts, one having the mirror specularity of 30; the other having the mirror specularity of 75. As shown in FIG. 9, triangular dots representing mirror specularity 30 (MS 30) are arranged rising upper rights. It means that as the toner density increases, the detection values also increases in correspondence with the increase of toner density. In a similar fashion, circular dots representing MS 75 also are arranged. Therefore, as the toner density increases, the detection values of MS 75 also increase. Compared with the results, the trend of MS 30 is less steep than that of MS 75 (Trend: MS 75>MS 30). That is because, in case of MS 30, specular reflection light is hardly generated from the toner image at the surface of the belt, a variation of detection values with respect to differences of toner density is small so that the toner image density is not accurately detected by the image density detection unit 60. On the other hand, in case of MS 75, since specular reflection light is easily generated from the toner image at the surface of the belt, a variation of detection values with respect to differences of toner density is large so that the toner image density is accurately detected by the image density detection unit 60. It is assumed that, regarding the variation of detection values with respect to the toner density, MS 75>MS 30. It is also assumed that, regarding the detection accuracy of the density of the toner image, MS 75>MS 30. When the variation of mirror specularities in each portion of an entire belt, detection accuracy for a density of a toner image varies depending on portions of the belt in which the toner image is transferred so that the toner density cannot be accurately corrected based on the detected density of the toner image. According to the above results, the detection accuracy of the toner density for the toner image by the image density detection unit 60 is improved by setting the mirror specularities of the base layer to 40-60.

Further, with respect to the detection accuracy of the image density detection unit 60 for the mirror specularities of the base layer of the belt, when the belt with the mirror specularity of 30 was used, clear differences of the detection values for a toner density were not obtained in an area in which the toner density of the toner image was low because the detection values of the toner density were similar. On the other hand, when the belt with the mirror specularity of 75 was used, clear differences of the detection values for a toner density were obtained even in an area in which the toner density of the toner image was low. The image density detection unit 60 detects the density of the toner 24 based on a degree of decreased light quantity of specular reflection light that is caused by the toner 24 transferred on the belt. Therefore, because the degree of decreased light quantity of specular reflection light is large by increasing light quantity of specular reflection light from the surface of the belt, accuracy for density correction of the toner 24 can be improved.

Especially, with respect to the detection accuracy of a toner image in black color of the image detection unit 60 for the mirror specularities of the base layer of the belt, when the image density detection unit 60 detects a density of the toner image in black color, the image density detection unit 60 detects the toner density of the toner image based on a degree of decreased light quantity of specular reflection light from the toner image transferred on the surface of the belt as the surface of the belt is an optical reference surface. Therefore, because the degree of decreased light quantity of specular reflection light is relatively large by increasing light quantity of specular reflection light from the surface of the belt, accuracy for detecting the toner density of the toner image and for correcting the toner density based on the detection results is improved. Specifically, for example, even though density differences for the toner image in black color are small, such as 30%, 35% and 40%, and when light quantity of specular reflection light from the belt is large, the density differences can be accurately detected because the degree of decreased light quantity of the specular reflection light is relatively large.

As discussed above, the belt that is provided at the belt device 31 of the second embodiment according to the present invention is formed in the following manner. Since the coat layer with a layer thickness of 100 nm-500 nm is formed on the base layer of which the mirror specularity is 40-60, an occurrence of the interference fringes on the belt is prevented, the mirror specularity of the upper most surface of the belt is equal to or more than 75, and the light quantity of the specular reflection light at the upper most surface of the belt is increased. Therefore, accuracy for detecting the toner density of the toner image and for correcting the toner density based on the detection results is improved in the image density detection unit 60.

In the above first and second embodiments, a color printer in a tandem system is explained as the image forming device 1. However, the image forming device 1 according to the present embodiments can be assembled to a photocopy machine, an inkjet printer, a black and white printer, a facsimile machine, a multifunction machine and so on. The belt configuration can be applied to an endless belt, such as a photosensitive belt, a fusion belt, and a carrying belt. In the present embodiments, the belt is used as an image carrier for a toner image. However, the present embodiments can be applied to following configuration. A toner density of the toner 24 can be detected by detecting a toner image transferred on an intermediate belt (not shown).

In the above first and second embodiments, the light emitting element 61 of the image density detection unit 60 is explained as an infrared LED. However, LEDs or the like for visible light or ultraviolet light can be used. The developing unit 20 is configured with four developing units that develop image information corresponding to four color, black, yellow, magenta and cyan. A developing unit corresponding to three color except black can be also used. Similarly, a developing unit can have two sets of the developing unit 20K that develops image information corresponding only to black. Configurations of the developing unit 20, such as the number, a combination of color, assemble locations and so on should not be limited to the above embodiments. They can be changed in many ways without departing from the spirit and scope of the invention.

The image forming device being thus described, it will be apparent that the same may be varied in many ways. Such variations are not to be regarded as a departure from the spirit and scope of the invention, and all such modifications as would be apparent to one of ordinary skill in the art are intended to be included within the scope of the following claims.

What is claimed is:

1. A belt device, comprising:

an endless belt including at least a base layer and a coat layer, the coat layer formed on the base layer and configuring an upper most surface of the belt;

a driving member that is provided inside the belt to bias an inner circumferential surface of the belt, and that is configured to rotate the belt; and a driven member that is provided inside the belt to bias the inner circumferential surface of the belt, and that is driven by the belt as the belt is rotated by the driving member, wherein the base layer has a mirror specularity of 20-60, and a layer thickness of the coat layer is 100 nm-500 nm.

2. The belt device according to claim 1, wherein
the mirror specularity is determined based on a strength of reflection light with respect to a dark part and a light part of a test pattern that is projected on the belt.

3. The belt device according to claim 1, wherein
a test pattern projected on the belt includes a plurality of slit-like shapes.

4. The belt device according to claim 1, wherein
the mirror specularity is determined based on an average value of maximal values (Max(Ave)) that corresponds to a strength of reflection light for a light part and an average value of minimal values (Min(Ave)) that corresponds to a strength of reflection light for a dark part by using an expression as follows:

$$\text{Mirror Specularity} = \frac{\text{Max}(Ave) - \text{Min}(Ave)}{\text{Max}(Ave) + \text{Min}(Ave)} \times 1000$$

$$\text{Here: Max}(Ave) = \frac{\sum \text{Max}(n)}{n}$$

$$\text{Min}(Ave) = \frac{\sum \text{Min}(n)}{n}.$$

5. The belt device according to claim 1, wherein
the mirror specularity of the base layer is 40-60.

6. The belt device according to claim 1, wherein
the coat layer is made of a polymer.

7. The belt device according to claim 6, wherein
the polymer is one selected from a group of poly-acrylic urethane, poly-acrylic, polyester-urethane, polyether-urethane, polycarbonate (PC), polybutylene terephthalate (PBT), polyethylene terephthalate (PET), styrene compound, and naphthalene compound.

8. The belt device according to claim 6, wherein
a thickness of the polymer is 100 nm-500 nm.

9. A transferring unit, comprising:
a belt device comprising:
an endless belt including at least a base layer and a coat layer, the coat layer formed on the base layer and configuring an upper most surface of the belt;
a driving member that is provided inside the belt to bias an inner circumferential surface of the belt, and that is configured to rotate the belt; and
a driven member that is provided inside the belt to bias the inner circumferential surface of the belt, and that is driven by the belt as the belt is rotated by the driving member, wherein
the base layer has a mirror specularity of 20-60,
a layer thickness of the coat layer is 100 nm-500 nm, and
a transferring roller is provided at an inner circumferential surface of the belt, on which a bias voltage is applied, and transfers a toner image to the belt or a recording medium provided on the belt.

10. The transferring unit according to claim 9, further comprising:
an image density detection unit that include a light emitting element and a light receiving element and that detect a density of the transferred image by irradiating light from the light emitting element and receiving reflection light from the transferred tonner image based on the irradiated light.

11. The transferring unit according to claim 9, wherein
the mirror specularity is determined based on a strength of reflection light with respect to a dark part and a light part of a test pattern that is projected on the belt.

12. The transferring unit according to claim 9, wherein
the mirror specularity is determined based on an average value of maximal values (Max(Ave)) that corresponds to the strength of the reflection light for the light part and an average value of minimal values (Min(Ave)) that corresponds to the strength of the reflection light for the dark part by using an expression as follows:

$$\text{Mirror Specularity} = \frac{\text{Max}(Ave) - \text{Min}(Ave)}{\text{Max}(Ave) + \text{Min}(Ave)} \times 1000$$

$$\text{Here: Max}(Ave) = \frac{\sum \text{Max}(n)}{n}$$

$$\text{Min}(Ave) = \frac{\sum \text{Min}(n)}{n}.$$

13. The transferring unit according to claim 9, wherein
the mirror specularity of the base layer is 40-60.

14. An image forming device, comprising:
the transferring unit according to claim 9;
a fusion unit that fuses the toner image by melting and pressing the toner image; and
an ejecting unit that receives the recording medium elected by the fusion unit.

15. An image forming device, comprising:
the transferring unit according to claim 9;
an image density detection unit that includes a light emitting element and a light receiving element and that detects a density of the transferred image by irradiating light from the light emitting element and by receiving reflection light from the transferred image based on the irradiated light; and
a control unit that receives an analog signal from the light receiving element, the analog signal corresponding to a strength of reflection light from the toner image, that converts the analog signal to a digital signal, that calculates a toner density of the toner image based on the digital signal, that calculates differences between the calculated toner density and a stored tone density that is predetermined and stored in a memory of the control unit, and that corrects the toner density.

16. The image forming device according to claim 14, further comprising:
an image density detection unit that include a light emitting element and a light receiving element and that detect a density of the transferred image by irradiating light from the light emitting element and receiving reflection light from the transferred image based on the irradiated light.

* * * * *